United States Patent [19]

Krämer et al.

[11] Patent Number: 4,875,449

[45] Date of Patent: Oct. 24, 1989

[54] ARRANGEMENT FOR PREVENTION OF TROUBLESOME LOAD CHANGE SHOCKS IN AN INTERNAL COMBUSTION ENGINE SERVING TO PROPEL A VEHICLE

[75] Inventors: Karl-Martin Krämer, Wolfsburg; Richard Dorenkamp, Isenbüttel, both of Fed. Rep. of Germany

[73] Assignee: Volkswagen AG, Wolfsburg, Fed. Rep. of Germany

[21] Appl. No.: 259,971

[22] Filed: Oct. 19, 1988

[30] Foreign Application Priority Data

Nov. 20, 1987 [DE] Fed. Rep. of Germany ..... 3739361

[51] Int. Cl.[4] ..... F02D 11/04

[52] U.S. Cl. ..... 123/400; 123/373; 251/78

[58] Field of Search ..... 123/364, 372, 373, 376, 123/396, 400; 74/513; 251/78; 261/65

[56] References Cited

U.S. PATENT DOCUMENTS 4,721,281 1/1988 Kratt et al. ..... 123/400 X
4,811,712 3/1989 Itow ..... 123/400 X
4,819,598 4/1989 Mueller ..... 123/399

FOREIGN PATENT DOCUMENTS 3632035 4/1987 Fed. Rep. of Germany .

*Primary Examiner*—Tony M. Argenbright
*Attorney, Agent, or Firm*—Brumbaugh, Graves, Donohue & Raymond

[57] ABSTRACT

In order to prevent troublesome load change shocks in an internal combustion engine for a vehicle, the power control element thereof consists of an adjustment lever operationally positioned between two spring stops. The first spring stop provides elastic transmission of accelerator pedal commands from a fuel control cable and the second spring stop, which comprises a stronger spring, is effective only after the adjustment lever moves through a preset free path and engages a support fixed on the housing. As a result, during a fuel control cable motion defined by the first spring stop, the adjustment lever is not moved, whereas thereafter, during a further fuel control cable motion, the adjustment lever is moved since the force of the spring associated with the second stop is overcome.

5 Claims, 1 Drawing Sheet

Fig. 1
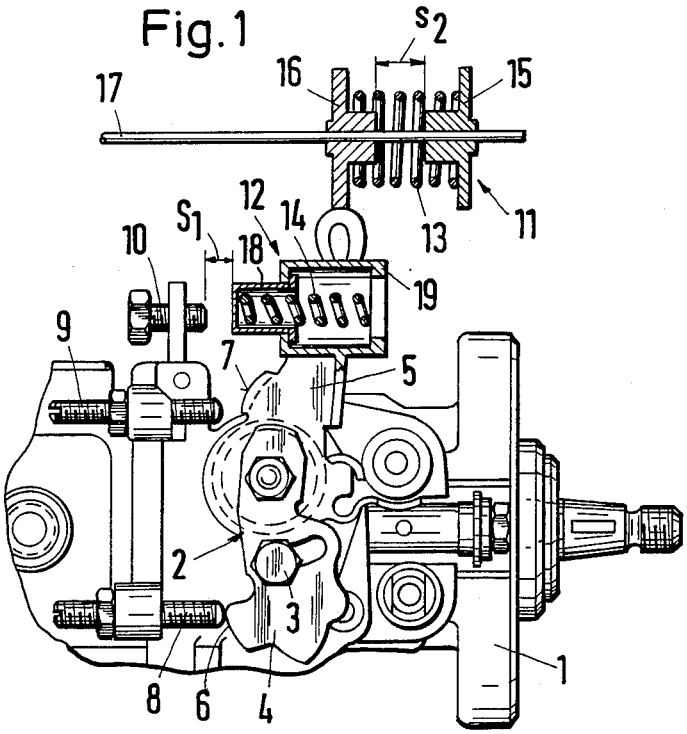
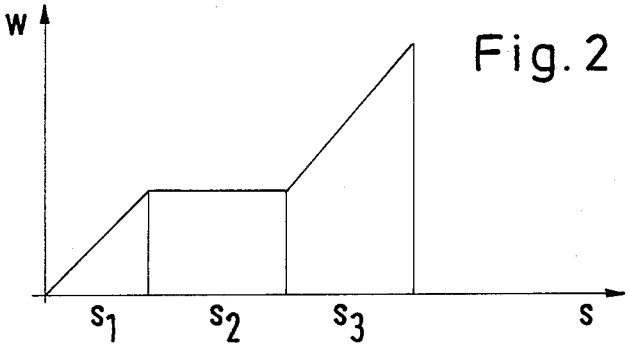
Fig. 2
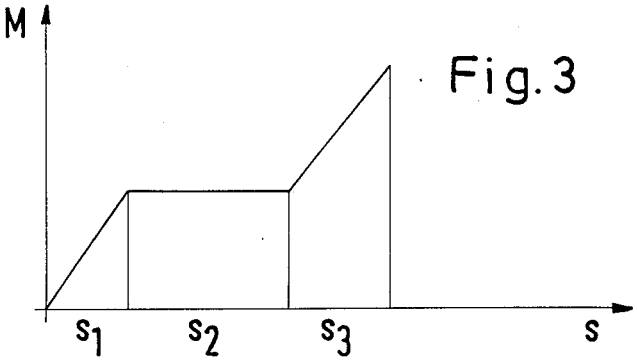
Fig. 3

ARRANGEMENT FOR PREVENTION OF TROUBLESOME LOAD CHANGE SHOCKS IN AN INTERNAL COMBUSTION ENGINE SERVING TO PROPEL A VEHICLE

BACKGROUND OF THE INVENTION

This invention relates to engine speed change control arrangements and, more particularly, to an arrangement for preventing load change shocks in an engine used to drive a vehicle.

In the U.S. Pat. No. 4,819,598, to Eckart Müller, issued Apr. 11, 1989, an arrangement is described for limiting the effect (by way of a time delay) of accelerator pedal commands in the region of the zero passage of the torque curve of the engine. This arrangement is based on the knowledge that the load change shocks which occur on load changes, i.e., on transition from engine braking operation to traction operation and vice versa, which shocks may lead to longitudinal oscillations of the vehicle known as jerking, have their origin in the sign inversion of the torque on transition from engine braking to traction and vice versa. Consequently, that application, in a manner different from the state of the art existing at the time, describes an arrangement for limiting the transmission of the accelerator pedal commands to the power control element only in load regions associated with the zero passage on the torque transmission curve. In systems of that type, limitation of the torque transmission curve region in which the effect of the accelerator pedal command is reduced is of interest particularly in view of the fact that, when the need arises, rapid acceleration of the vehicle must be possible.

The arrangement described in U.S. Pat. No. 4,819,598 operates electronically and requires storage of the engine performance characteristics so that, generally speaking, it can be utilized only in vehicles with electronic engine control. The commonly-assigned U.S. patent application of Eckart Müller and Richard Dorenkamp, U.S. Ser. No. 206,874, filed June 9, 1988, also describes an engine control arrangement which specifically concerns the fuel injection pump of the engine. That arrangement includes a valve which is actuated only at the start of accelerator pedal movement out of the zero load position during a predefined time span, providing a limitation on the fuel quantity reaching the injection nozzle in approximately the zero load demand region of the engine operation.

Although the arrangement described in application Ser. No. 206,874 operates by hydraulic devices, a mechanically driven actuating device for the power control element of an internal combustion engine is known from German Offenlegungsschrift No. 36 32 035. In that device, a gas control cable contains a tension spring ahead of a swivelling lever whose motions are coupled with those of the power control element and a pneumatic piston-cylinder arrangement following the swivelling lever. In addition, the end of the gas control cable is connected to the piston bearing through a tension spring. The piston-cylinder arrangement defines pressure chambers on both sides of the piston, which at piston positions corresponding to low engine outputs are connected only by a throttle bore, but at larger engine outputs are connected through a practically throttle-free bypass. This known arrangement does not provide for individual adjustment with respect to the zero passage position of the torque transmission curve of the internal combustion engine.

SUMMARY OF THE INVENTION

Accordingly, it is an object of the present invention to provide an engine speed control arrangement which overcomes the above-mentioned disadvantages of the prior art.

Another object of the invention is to provide an arrangement for preventing load shocks in internal combustion engines utilizing either carburetors or fuel injection and which, while being simple, low in cost and therefore easily produced on an industrial scale, permits the individual adjustment of the zero passage on the torque transmission curve.

These and other objects are attained according to the invention by providing an engine having a power output control element arranged between first and second springs, the first spring being weaker than the second spring and being operationally disposed between the power control element and the accelerator pedal and the second spring being operationally disposed between the power control element and a fixed support and in spaced relation to one of them so that continued motion of the accelerator pedal first moves the power control element to close the space between that element and the fixed support, then compresses the first spring without moving the control element, and then moves the control element to compress the second spring.

A special advantage of the invention results from its simple construction. The entire arrangement is based upon the provision of two spring stops and a fixed support for the second one of the said stops which, being adjustable, makes it possible to effect the individual adjustment of the zero passage.

BRIEF DESCRIPTION OF THE DRAWINGS

Further objects and advantages of the invention will be apparent from a reading of the following description in conjunction with the accompanying drawings, in which:

FIG. 1 is a schematic view, partly in section, illustrating a representative engine control arrangement according to the invention;

FIG. 2 is a graphical representation illustrating the relation between the motion of the accelerator pedal and the angular position of a control element in the embodiment of FIG. 1; and FIG. 3 is a graphical representation showing the relation between the motion of the accelerator pedal and the quantity of fuel injected into the engine in the embodiment of FIG. 1.

DESCRIPTION OF PREFERRED EMBODIMENT

In the typical embodiment of the invention shown in FIG. 1, a fuel injection pump of conventional construction has a housing 1 in which an adjustment lever 2 is connected in a torsion-transmitting fashion with the power control element of the fuel injection pump. The adjustment lever 2 has two parts 4 and 5 connected in a torsion-transmitting fashion by a locking screw 3. In addition, the lever 2 has rigid stop surfaces 6 and 7 which engage an idling stop 8 and a full load stop 9, respectively, in corresponding angular positions of the lever. The two stops 8 and 9, which are fixed on the pump housing 1, consist of threaded bolts so that the stop positions can be adjusted separately. The pump housing 1 also carries a threaded stop bolt 10, the purpose of which will be explained hereinafter.

The upper end of the adjustment lever 2, as shown in FIG. 1, is movable between two spring stops 11 and 12 containing corresponding compression springs 13 and 14, respectively. The compression spring 13, which is designed so that it is slightly weaker than the compression spring 14, is mounted between two spring plates 15 and 16 which are separated by a distance $S_2$. The spring plate 15 is mounted at the end of a fuel control cable 17 which leads to an accelerator pedal, not shown, whereas the spring plate 16 is affixed to the adjustment lever 2. The fuel control cable 17 passes through the spring plate 16 without restriction.

Turning to the second spring stop 12, it will be noted that its motion is linked to that of the adjustment lever 2 and that it consists of a spring housing comprising a cupshaped part 18 and a cylindrical part 19 in telescoping relation. Important for the operation of this embodiment of the invention is the fact that the support 10 and the stop 12 are spaced by a distance $S_1$. This means that contact between those elements, and thus, initiation of the compression of the second spring stop 12, occurs only after a corresponding angular motion of the adjustment lever 2.

In FIG. 1, the fuel pump lever 2 is illustrated in the idling position as defined by the idling stop 8. At the start of an accelerator pedal depression, which moves the fuel control cable 17 to the left in FIG. 1, the adjustment lever 2 is turned counterclockwise through an angle corresponding to the spacing $S_1$ so that the second spring stop 12 engages the support 10. As shown in the diagram of FIG. 2, in which the motion of the accelerator pedal is represented by $S_1$, the angle w of the adjustment lever 2 changes continuously as the gap $S_1$ is closed. From then on, i.e., on continued movement of the accelerator pedal, and thus of the fuel control cable 17, to the left, the weaker spring 13 in the first spring stop 11 is compressed until the gap $S_2$ has been closed i.e., until there is contact between the spring plates 15 and 16. Throughout that motion, the angular position of the adjustment lever 2 is kept constant. This is illustrated by the second portion of the diagram in FIG. 2, which shows that, while the gap $S_2$ is being closed, the line representing the angle w remains parallel to the abscissa. On further movement of the accelerator pedal, and thus of the fuel control cable 17, to the left in FIG. 1, a further angular motion of the adjustment lever 2 occurs as the spring 14 of the second spring stop 12 is compressed. The corresponding control cable path is designated by $S_3$ in FIG. 2. This motion ends when the full load stop 9 is engaged, preventing further angular motion of the adjustment lever 2.

In FIG. 3, the fuel injected by the pump M is plotted against the position of the fuel control cable position S. A comparison of FIGS. 2 and 3 shows that the ends and, respectively, beginnings of the various regions for the changes in fuel injection M need not coincide precisely with the changes in angular motion w of the adjustment lever 2.

By a corresponding adjustment of the support 10 fixed on the housing, the start of the region $S_2$, in which the effect of a further accelerator pedal command on the fuel quantity delivered to the engine is completely eliminated, can be adapted to the individual characteristics of the pump and of the internal combustion engine to be supplied by the pump.

The invention provides a simple arrangement for preventing troublesome load change shocks in an internal combustion engine for vehicles which is of simple construction and is thus reliable and low in cost while complying with all necessary fuel control demands. It may also be utilized in carburetor engines with a throttle valve as the power control element.

Although the invention has been described herein with reference to a specific embodiment, many modifications and variations of the invention will readily occur to those skilled in the art. Accordingly, all such variations and modifications are included within the intended scope of the invention.

We claim:

1. Apparatus for preventing troublesome load change shocks in an internal combustion engine for driving a vehicle comprising a power control element, adjustment lever means for the power control element, engine power control means delivering commands for said power control element, first spring means operationally positioned between the engine power control means and the adjustment lever means, and second spring means stronger than the first spring means and operationally positioned between the adjustment lever means and a stop member, whereby the adjustment lever means is first moved from an idling position by motion of the engine power control means, then remains stationary during further movement of the engine power control means, and then moves again during still further movement of the engine power control means.

2. Apparatus according to claim 1 wherein the second spring means includes a spring housing having a cupshaped part and a cylindrical part disposed in telescoping relation.

3. Apparatus according to claim 1 or claim 2, wherein the second spring means is operationally connected to the engine power control element.

4. Apparatus according to claim 1 or claim 2 including adjustable stop means cooperating with the second spring means for controlling the response of the adjustment lever means to initial motion of the engine power control means.

5. Internal combustion engine for driving a vehicle having a power control element arranged between first and second springs, the first spring being weaker than the second spring and being operationally disposed between the power control element and an accelerator pedal and the second spring being operationally disposed between said power control element and a fixed support and in spaced relation to one of them so that continued motion of the accelerator pedal moves the power control element to close the space between that element and the fixed support, then compresses the first spring without moving the power control element, and then moves the power control element to compress the second spring.

* * * * *